US010111569B2

(12) United States Patent
Yan

(10) Patent No.: US 10,111,569 B2
(45) Date of Patent: Oct. 30, 2018

(54) CLEARING FABRIC ASSEMBLY USED FOR AN AUTOMATIC CLEANING MACHINE

(71) Applicant: Jason Yan, New Taipei (TW)

(72) Inventor: Jason Yan, New Taipei (TW)

( * ) Notice: Subject to any disclaimer, the term of this patent is extended or adjusted under 35 U.S.C. 154(b) by 366 days.

(21) Appl. No.: 14/985,386

(22) Filed: Dec. 30, 2015

(65) Prior Publication Data

US 2016/0367099 A1 Dec. 22, 2016

(30) Foreign Application Priority Data

Jun. 16, 2015 (TW) ..... 104119349 A

(51) Int. Cl.

| | |
|---|---|
| ***A47L 11/24*** | (2006.01) |
| ***A47L 11/16*** | (2006.01) |
| ***A47L 11/40*** | (2006.01) |
| ***A47L 11/164*** | (2006.01) |

(52) U.S. Cl.

CPC ..... *A47L 11/24* (2013.01); *A47L 11/164* (2013.01); *A47L 11/4038* (2013.01); *A47L 11/4044* (2013.01); *A47L 2201/00* (2013.01)

(58) Field of Classification Search

CPC ..... A47L 11/24; A47L 11/16; A47L 11/164; A47L 11/28; A47L 11/283; A47L 11/4036; A47L 11/4038

USPC ..... 15/230, 230.16, 230.17, 230.19

See application file for complete search history.

(56) References Cited

U.S. PATENT DOCUMENTS

| | | | | |
|---|---|---|---|---|
| 736,736 A * | 8/1903 | Kane | A47L 11/164 | 15/230.17 |
| 2014/0237743 A1* | 8/2014 | Baker | A47L 11/4038 | 15/98 |

* cited by examiner

*Primary Examiner* — Laura C Guidotti

(74) *Attorney, Agent, or Firm* — Chun-Ming Shih

(57) ABSTRACT

A cleaning fabric assembly used for an automatic cleaning machine includes an outer unit, a water absorbent unit, an assembly unit and a fixing unit. A plurality of openable portions, which extend from the peripheral portion of the outer unit to the center of the outer unit, are provided on top of the outer unit. The water absorbent unit and assembly unit and may inserted into the outer unit through the cracks between the openable portions. The cleaning fabric assembly of the present invention may be used to remove water stains with its water absorbent unit or by mopping the floor. Also, to uninstall the outer unit or the water absorbent unit for replacement or cleaning, a user simply has to rotate the fixing unit to disengage the male engagement pieces from the engagement portions.

17 Claims, 15 Drawing Sheets

CLEARING FABRIC ASSEMBLY USED FOR AN AUTOMATIC CLEANING MACHINE

BACKGROUND OF THE INVENTION

1. Field of the Invention

The invention generally relates to a cleaning fabric assembly used for a sweeping machine. More particularly, the invention relates to a cleaning fabric assembly that has two functions: sweeping and mopping and that may be installed and uninstalled easily.

2. Description of the Prior Art

Smart vacuum cleaner is also known as sweeping robot, in which sensors (such as infrared, lenses, iAdapt technology or laser scanning) are used to detect obstacles. In addition, forces of impacts are reduced through impact force reducing design or the reduction of speed as an obstacle approaches. Also, dust and debris are gathered through its cleaning device (such as brush or cleaning fabric) and then are transferred to a dust gathering container to achieve the goals of sweeping and vacuuming. Furthermore, such sweeping robot may be set so that it will carry out cleaning after a certain period of time. In addition, it may recharge itself when its power level drops to a certain level. However, such sweeping robot only removes dust and debris; mopping has to be done by a person or a mopping robot.

Mopping robot available on the market is quite different from the sweeping robot because the former has only one virtual wall and will stop as the water stored inside is used up. Therefore, a user has to be present so that it will not be stuck and so as to add more water. Therefore, mopping robot is less popular than the sweeping robot. However, with its mopping function, it still acquires a certain share of the market.

Some people try to solve this problem by combining the advantages of the sweeping robot (equipped with sensors and impact force reducing design) with the benefit of the mopping robot. Because such new robot can not be too big (so that it may reach small corners), the sizes of its dust gathering container and water storage tank would be limited by such restrain, resulting a poor performance in sweeping and mopping. In addition, water in its water storage tank will still be used up and the robot will stop as this happens.

To eliminate the disadvantages of the prior art robots, the inventor has put in a lot of effort in the subject and has successfully come up with the cleaning fabric assembly of the present invention.

SUMMARY OF THE INVENTION

A first object of the present invention is to provide a cleaning fabric assembly with two functions: sweeping and mopping.

A second object of the present invention is to provide a cleaning fabric assembly with the function of water absorption.

A third object of the present invention is to provide a cleaning fabric assembly to impart the function of mopping to a sweeping machine.

A fourth object of the present invention is to provide a cleaning fabric assembly with the function of water stains removal.

To reach these objects, the cleaning fabric assembly of the present invention is provided. The cleaning fabric assembly of the present invention comprises an outer unit, a water absorbent unit, an assembly unit and a fixing unit. A plurality of openable portions, which extend from the peripheral portion of the outer unit to the center of the outer unit, are provided on top of the outer unit. A space is formed by and between these openable portions and the bottom of the outer unit. At least an opening is provided in each of the openable portions. The water absorbent unit and the fixing unit may be placed into the space through the cracks between the openable portions. The assembly unit is fitted between the openable portions and the water absorbent unit in the space. A plurality of engagement portions are circumferentially provided around the assembly unit and each of these engagement portions may pass through the corresponding opening. A positioning protrusion is provided on the bottom of the supportive portion. At least a male engagement piece is provided on the fixing unit. Each of these male engagement pieces may engage with the corresponding engagement portion.

In use, dust and debris may be gathered by the outer unit of the assembly of the present invention. Also, water stains may be removed by the water absorbent unit. In addition, after the water absorbent unit soaks in water, the assembly of the present invention may be used for mopping. Therefore, the cleaning fabric assembly of the present invention enables a single automatic cleaning machine to have dual function: sweeping and mopping. Also, to uninstall the outer unit or the water absorbent unit for replacement or cleaning, a user simply has to rotate the fixing unit to disengage the male engagement pieces from the engagement portions.

DETAILED DESCRIPTION OF THE PREFERRED EMBODIMENT

Figure 1:
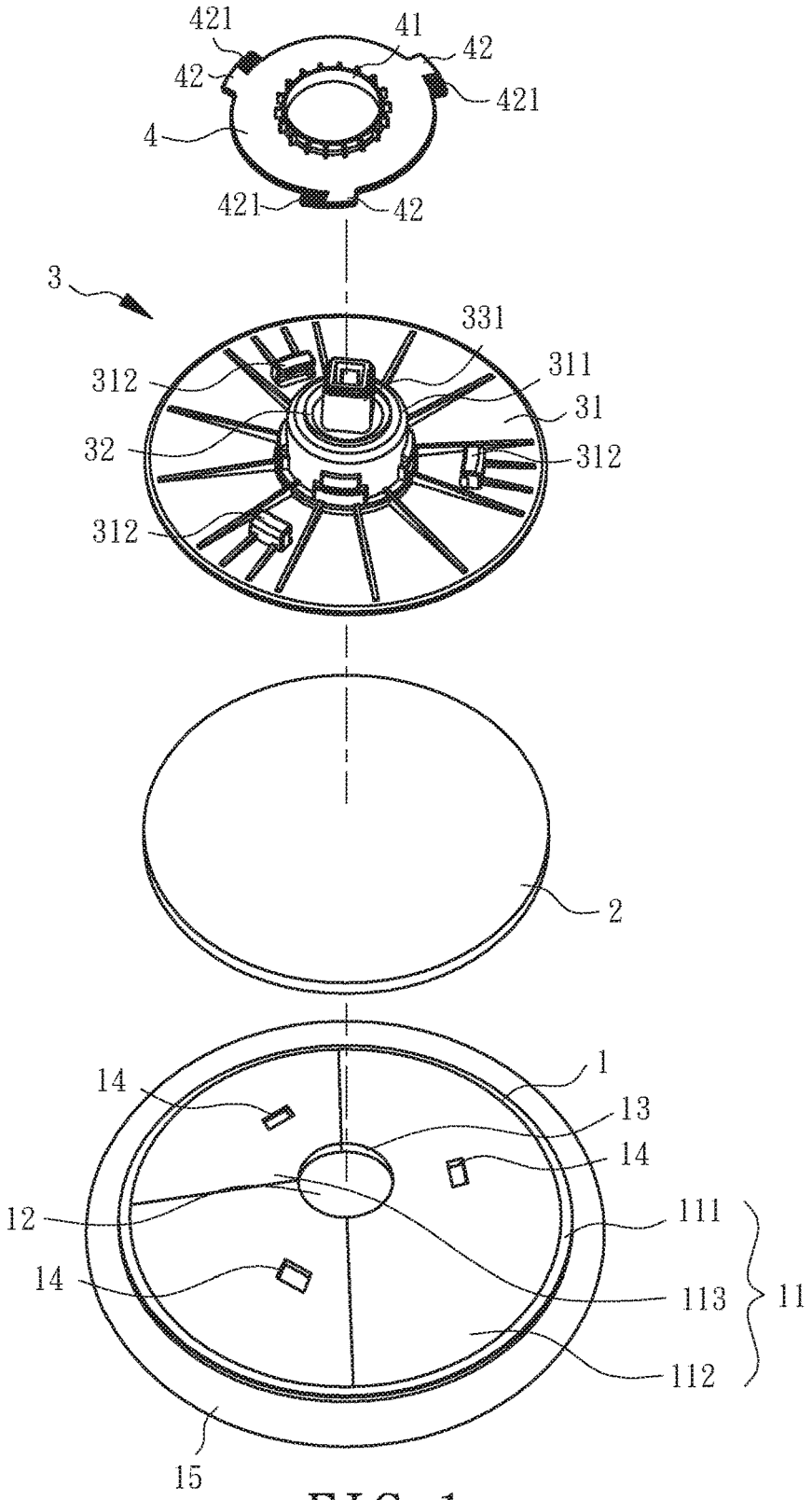
FIG. 1 is an exploded view of the cleaning fabric assembly of the present invention.
Figure 2:
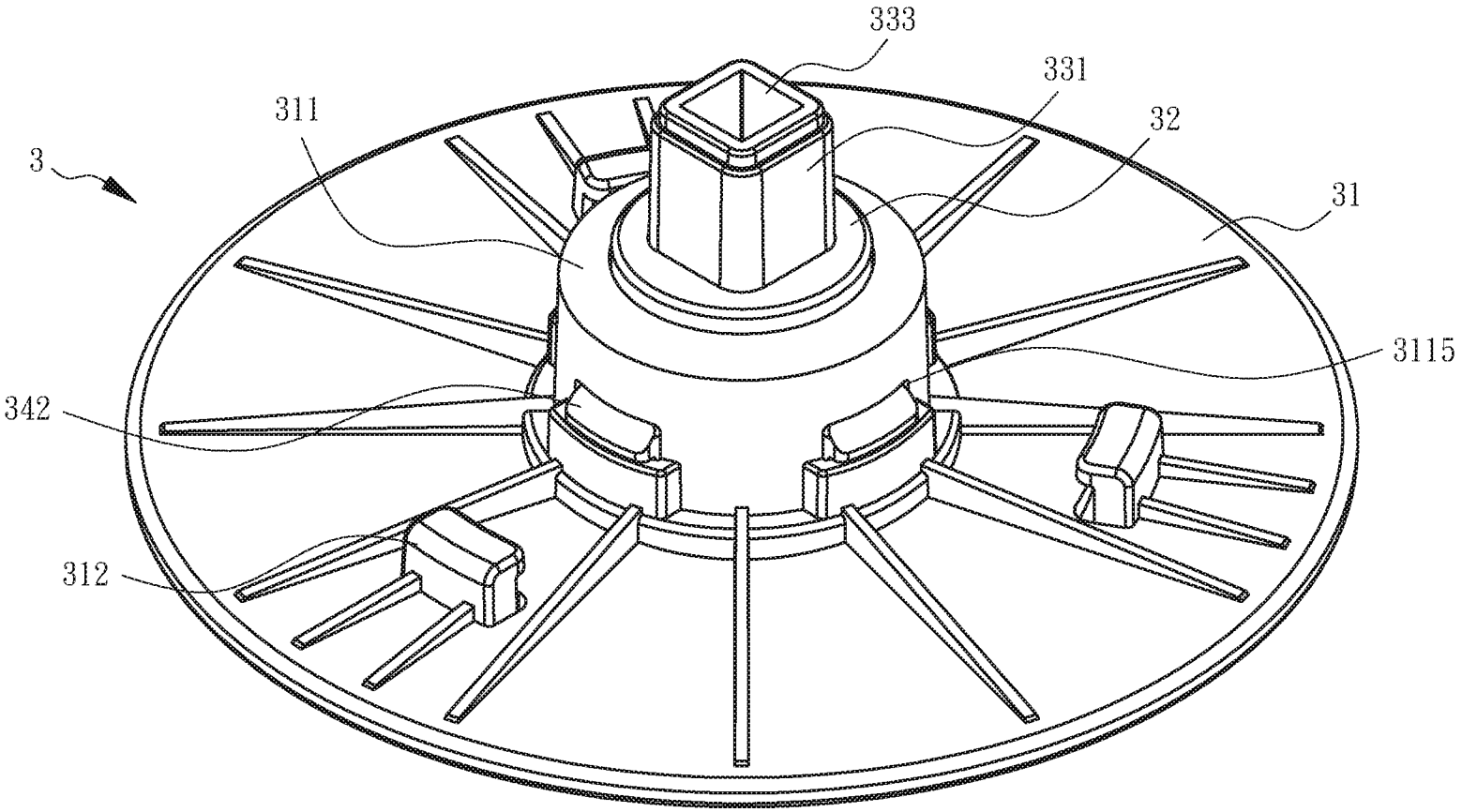
FIG. 2 is a perspective view of the assembly unit of the cleaning fabric assembly of the present invention.
Figure 3:
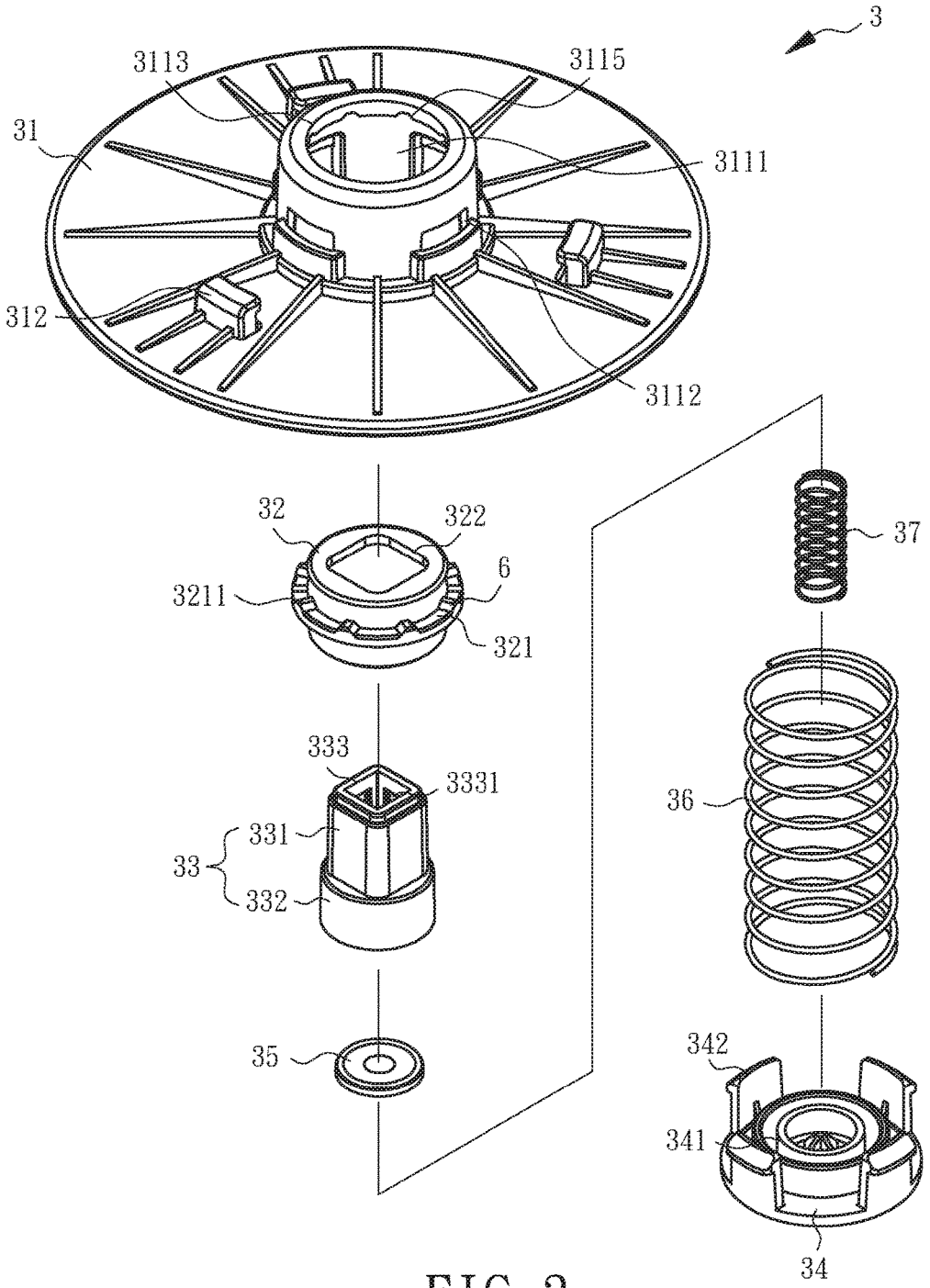
FIG. 3 is an exploded view of the assembly unit of the cleaning fabric assembly of the present invention.
Figure 4B:
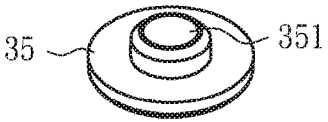
FIG. 4B is a bottom perspective view of the supportive portion of the cleaning fabric assembly of the present invention.
Figure 4A:
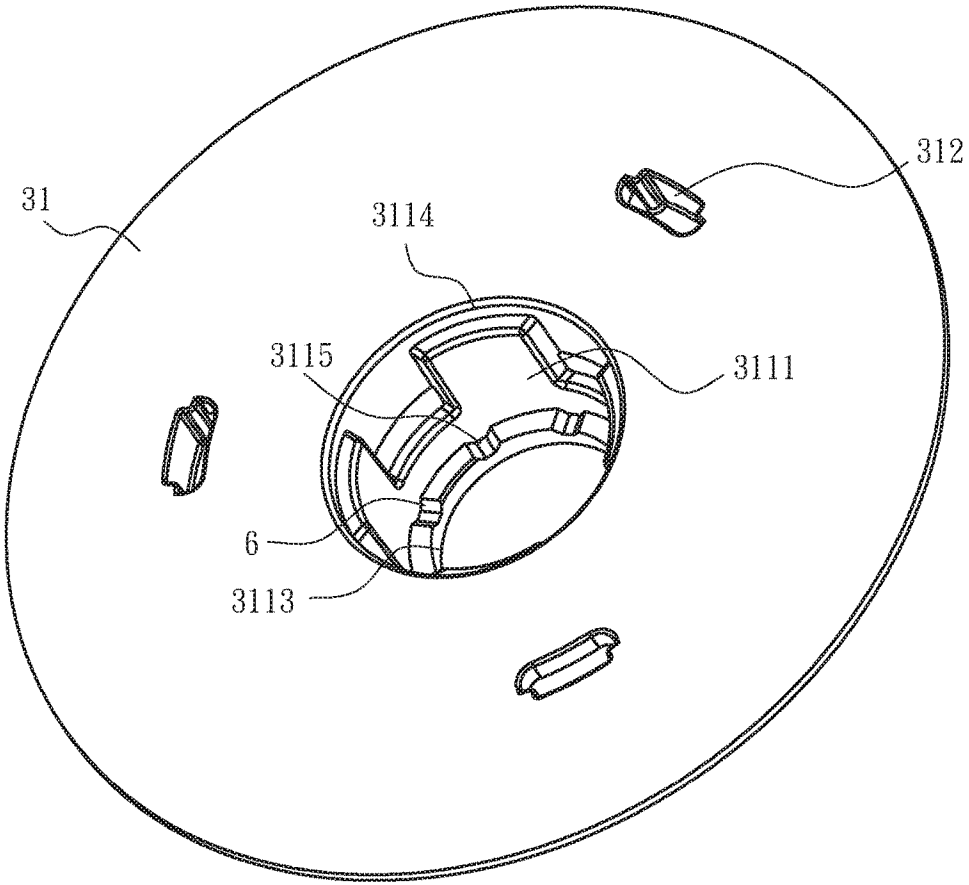
FIG. 4A is a bottom perspective view of the positioning seat of the cleaning fabric assembly of the present invention.
Figure 5:
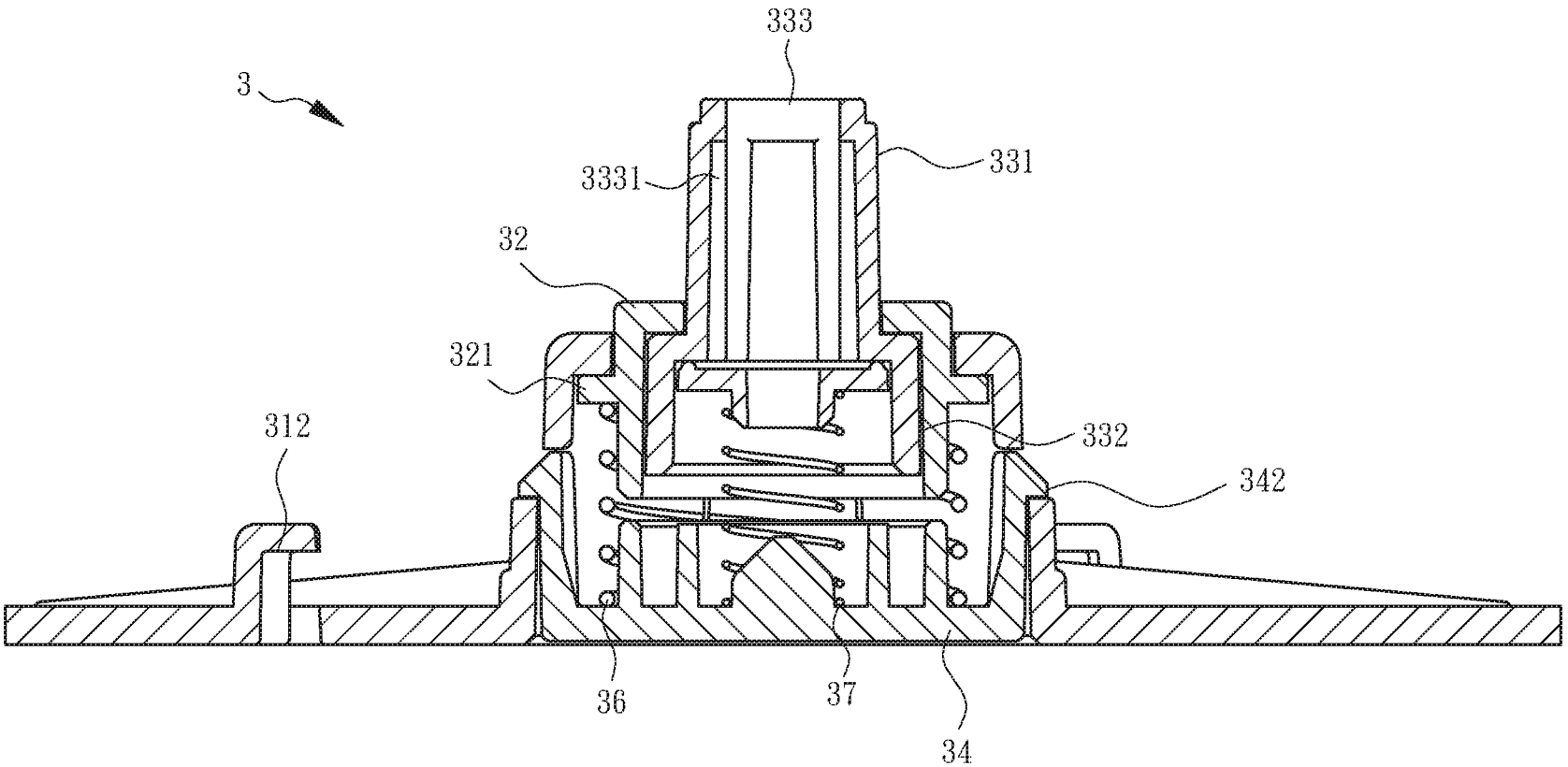
FIG. 5 is a sectional view of the assembly unit of the cleaning fabric assembly of the present invention.

As illustrated in FIGS. 1, 2, 3, 4A, 4B and 5, the cleaning fabric assembly of the present invention comprises an outer unit 1, a water absorbent unit 2, an assembly unit 3 and a fixing unit 4. A donut-shaped cleaning portion 15 is circumferentially disposed around the outer unit 1. A plurality of openable portions 11, which extend from the peripheral portion to the center of the outer unit, are provided on top of the outer unit 1. An aperture 13 is centrally formed by the openable portions 11. A space 12 is formed by and between the openable portions 11 and the outer unit 1. At least an opening 14 is provided in each of the openable portions 11.

The water absorbent unit 2 is made of water absorbing material and may be replaced or washable. The water absorbent unit 2 and assembly unit 3 may be moved into the space 12 through the cracks formed between the openable portions 11. The water absorbent unit 2 is fitted in between the outer unit 1 and the assembly unit 3.

The assembly unit 3 comprises a positioning seat 31, a positioning portion 32, a connective portion 33, a bottom portion 34, a supportive portion 35, a supportive spring 36 and a positioning spring 37. A connective portion 311 is centrally provided on the positioning seat 31 and an engagement portion 312, which spatially corresponds to each of the openings 14, is circumferentially provided on the positioning seat 31. The connective portion 311 comprises an inner space 3111, a plurality of connective slots 3112, an opening 3113, an installation opening 3114 and a plurality of engagement slots 3115. Each of connective slots 3112 is a through slot. Each of the connective slots 3112 passes through the side wall of the connective portion 311 and the opening 3113 is a through opening on top of the connective portion 311. The engagement slots 3115 are circumferentially disposed in the inner space 3111 near the opening 3113.

The positioning portion 32 comprises an outer ring 321 and an engagement opening piece 322. The outer ring 321 is circumferentially provided around the positioning portion 32 and has a plurality of engagement protrusions 3211, which may engage with the engagement slots 3115. The engagement opening piece 321 is rectangular and passes through the top and bottom of the positioning portion 32.

The connective portion 33 comprises a positioning piece 331 and a retaining piece 332. The positioning piece 331 is rectangular and has a connective piece 333, which is located on the top of the positioning piece 331. A positioning design 3331 is provided on the wall of the connective piece 333. The bottom portion 34 comprises a positioning ring piece 341 and a plurality of engagement pieces 342. The positioning ring piece 341 is centrally provided inside the bottom portion 34 and the engagement pieces 342 are circumferentially provided around the bottom portion 34.

The supportive portion 35 is fitted in between the connective portion 33 and the bottom portion 34. A positioning protrusion 351 is provided on the bottom of the supportive portion 35. The supportive spring 36 is fitted in between the supportive portion 35 and the bottom portion 34. The lower end of the supportive spring 36 is fitted to the positioning ring piece 341 and the upper end of the supportive spring 36 is fitted to a peripheral portion of the positioning protrusion 351. The lower end of the positioning spring 37 is fitted to a peripheral portion of the positioning ring piece 341 and its upper end presses against the lower side of the outer ring 321.

In assembly, first, the positioning portion 32 is fitted into the inner space 3111 of the connective portion 311 through the installation opening 3114. Now, its outer ring 321 presses against the lower side of the circular edge of the opening 3113 and the engagement protrusions 3211 engage with the engagement slots 3115 of the positioning seat 31. Next, insert the connective portion 33 into the connective portion 311 through the installation opening 3114 and the retaining piece 332 presses against the underside of the engagement opening piece 322, so that the positioning piece 331 passes through the opening 3113 of the connective portion 311 and the engagement opening piece 322. Then, place the supportive portion 35 into the inner space 3111 of the connective portion 311 through the installation opening 3114 with the positioning protrusion 351 facing the installation opening 3114. Next, insert the supportive spring 36 into the inner space 3111 of the connective portion 311 through the installation opening 3114 with the upper end of the supportive spring 36 connecting with a peripheral portion of the positioning protrusion 351. Then, insert the positioning spring 37 into the connective portion 311 through the installation opening 3114 with the upper end of the positioning spring 37 pressing against the lower side of the engagement protrusions 3211. Next, fit the positioning ring piece 341 to the lower end of the supportive spring 36, so that the lower end of the positioning spring 37 connects with the positioning ring piece 341. Then, press the bottom portion 34 towards the inner space 3111 of the connective portion 311, so that engagement pieces 342 enters the inner space 3111 and engages with the connective slots 3112. Now, the bottom portion 34 links up with positioning seat 31 to close the installation opening 3114; also, the positioning portion 32, connective portion 33, supportive portion 35, supportive spring 36 and positioning spring 37 are fitted inside the inner space 3111 of the positioning seat 31.

A positioning opening 41 is centrally provided in the fixing unit 4. A plurality of male engagement pieces 42 in a configuration identical to that of the engagement portions 312 are circumferentially provided on the fixing unit 4. An anti-slipping portion 421 is provided on the upper surface of each male engagement piece 42.

In the following, we will use an embodiment to illustrate the actual structure and assembling process of the cleaning fabric assembly of the present invention. In this embodiment, the outer unit 1 comprises three openable portions 11. The first openable portion 111 covers half of the upper surface area of the outer unit 1 and either the second openable portion 112 or third openable portion 113 covers a quarter of the upper surface area of the outer unit 1. A space 12 is formed between the outer unit 1 and the three openable portions 111, 112 and 113. An opening 14 is provided in each of the three openable portions 111, 112 and 113. Three engagement portions 312, each of which spatially corresponds to each of the three openings 14, are circumferentially provided around the connective portion 311. Three male engagement pieces 42, each of which spatially corresponds to each engagement portion 312, are circumferentially provided around the fixing unit 4.

Figure 6:
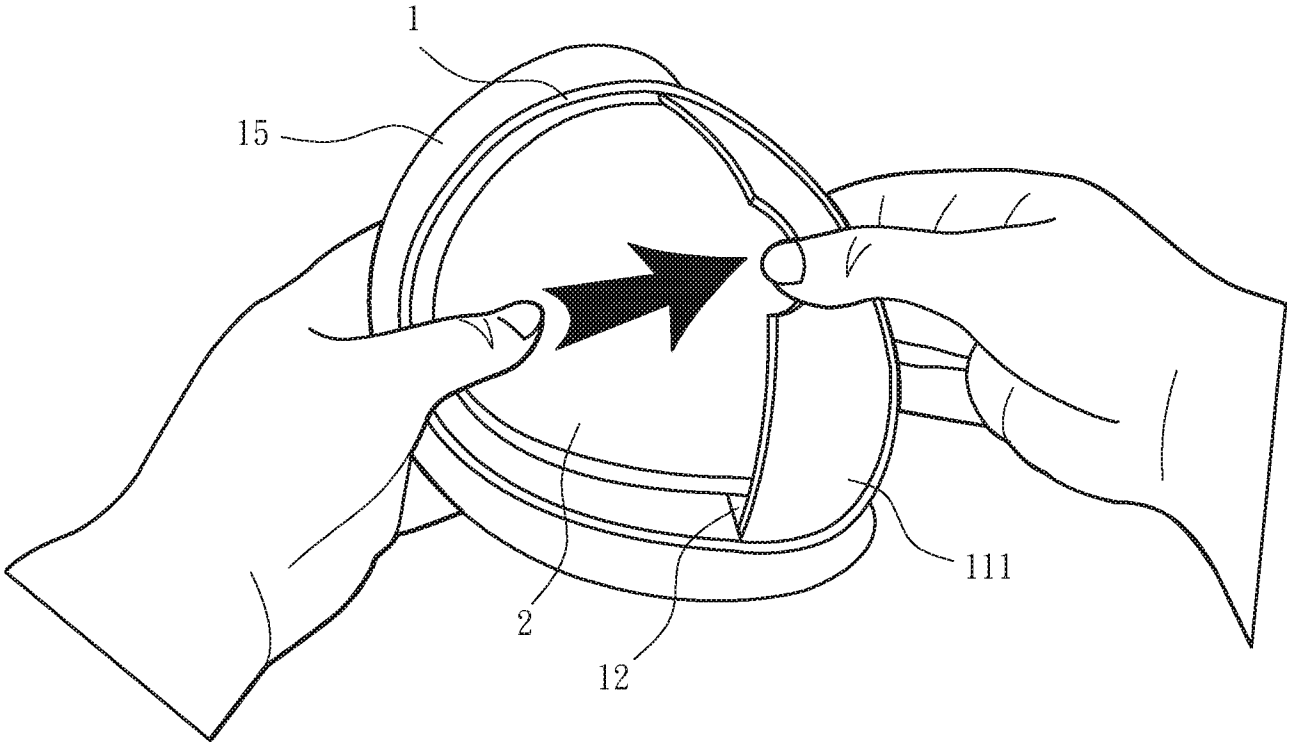
FIG. 6 is a first perspective view illustrating how the water absorbent unit is placed into the outer unit (1).
Figure 7:
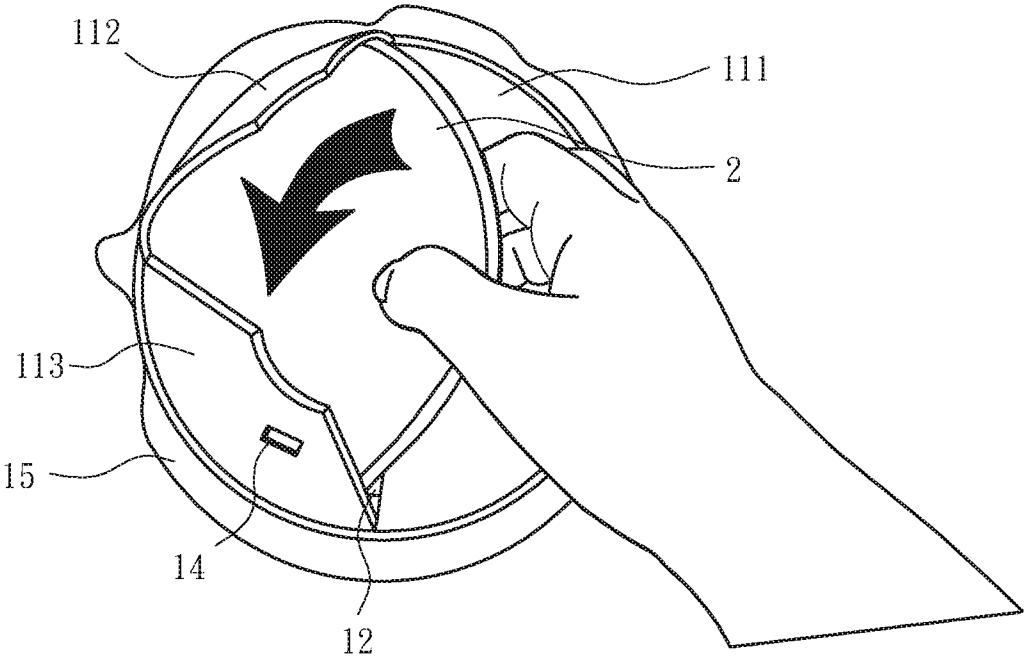
FIG. 7 is a second perspective view illustrating how the water absorbent unit is placed into the outer unit (2).
Figure 8:
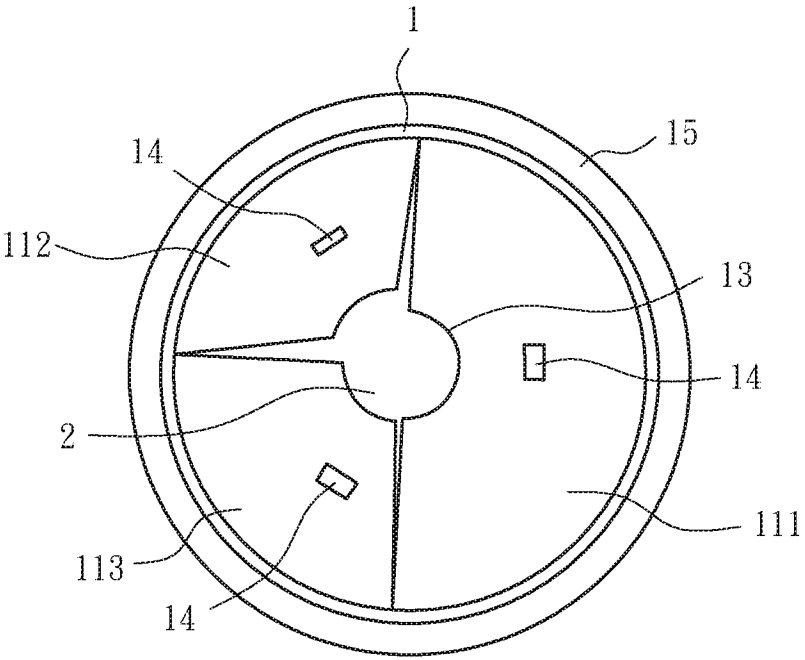
FIG. 8 is a third perspective view illustrating how the water absorbent unit is placed into the outer unit (3).

Please refer to FIGS. 6 to 8 to see how the water absorbent unit 2 is placed or inserted into the outer unit 1. First, use our thumb to partially open the first openable portion 111 and insert half of the water absorbent unit 2 into the space formed by and between the first openable portion 111 and the outer unit 1. Then, partially open the second openable portion 112 and third openable portion 113 and insert the other half of the water absorbent unit 2 into the space formed by and between the second and third openable portions 112 and 113 and the outer unit 1. Next, close the second openable portion 112 and third openable portion 113. Now, the water absorbent unit 2 is placed inside the space 12.

Figure 9:
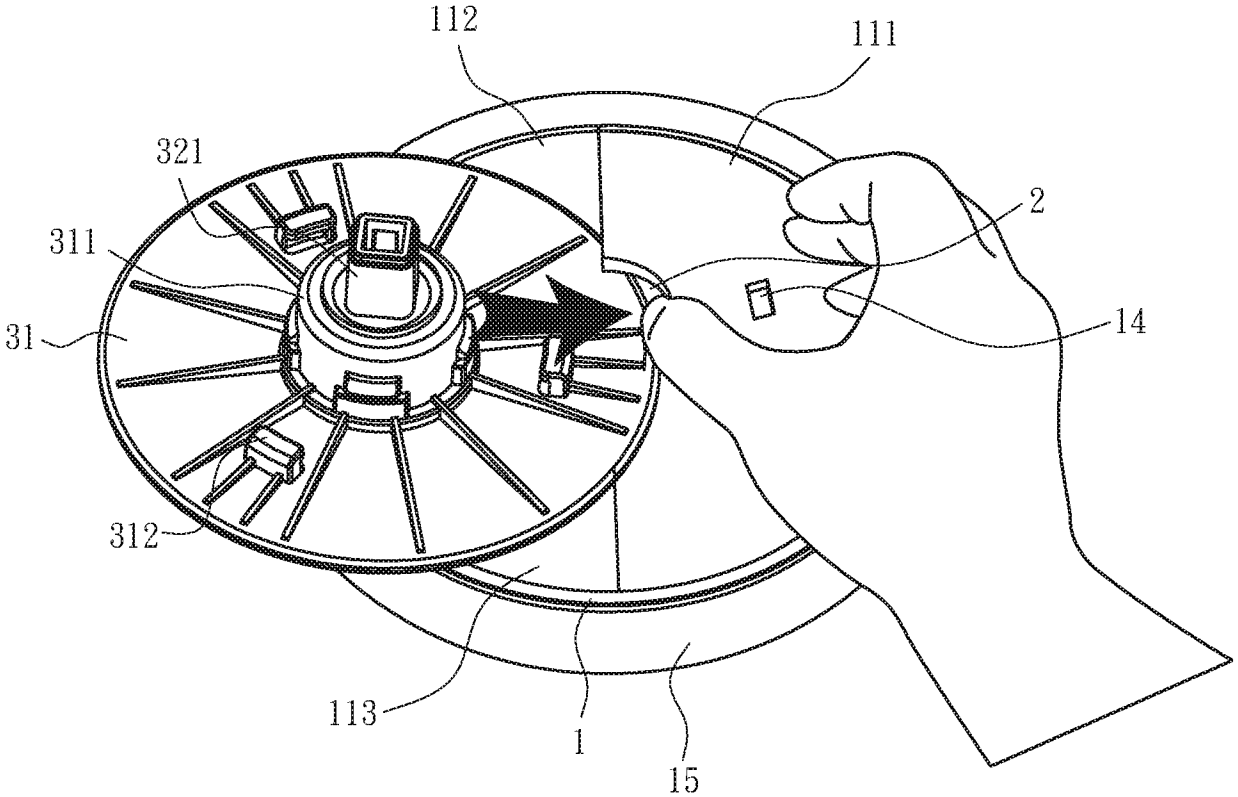
FIG. 9 is a first perspective view illustrating how the assembly unit is placed into the outer unit (1).
Figure 10:
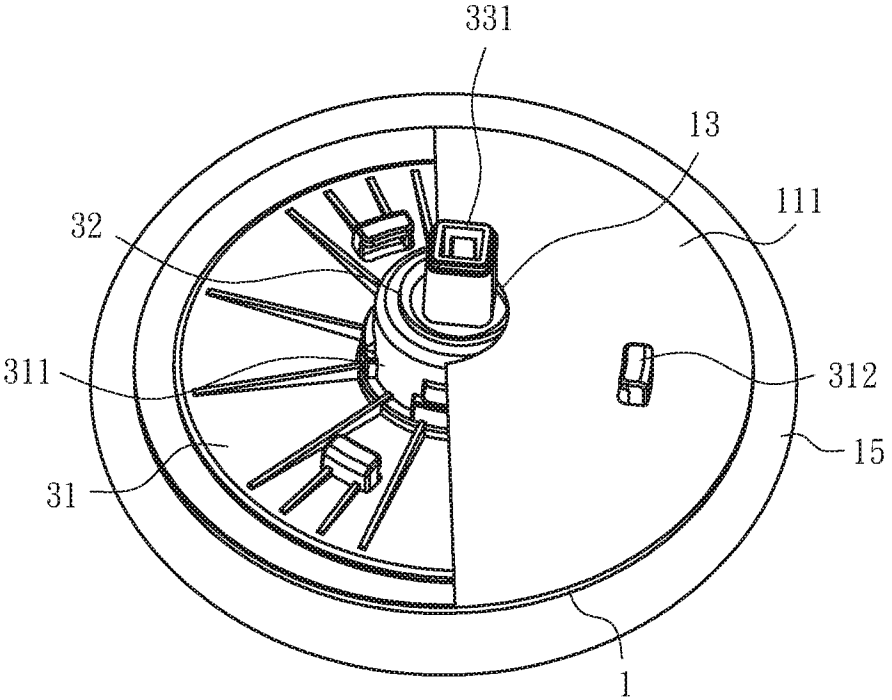
FIG. 10 is a second perspective view illustrating how the assembly unit is placed into the outer unit (2).
Figure 11:
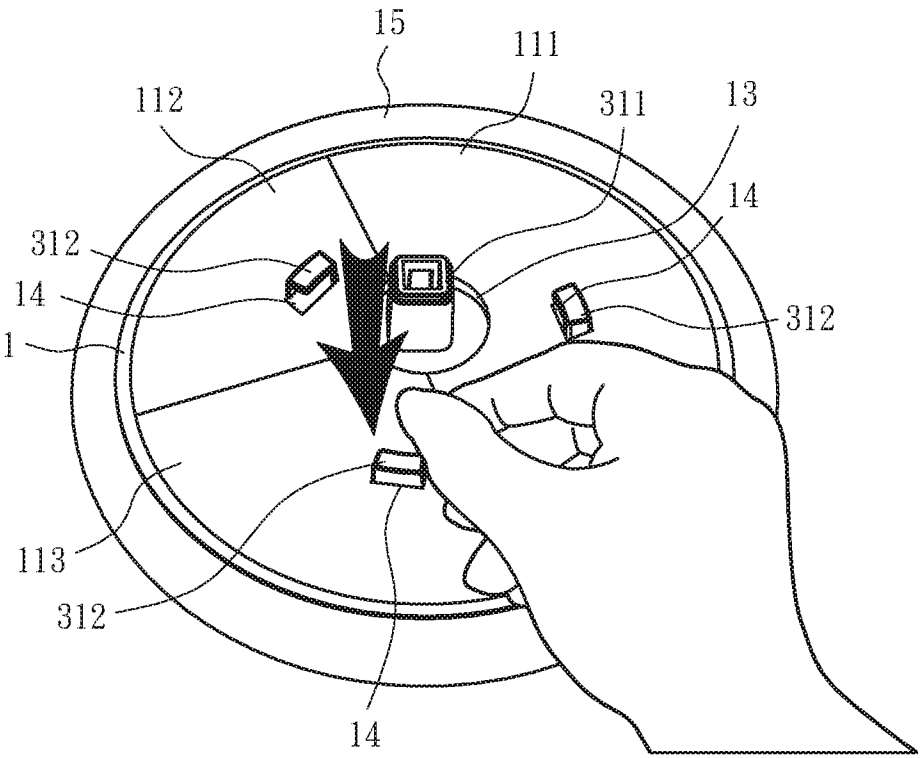
FIG. 11 is a third perspective view illustrating how the assembly unit is placed into the outer unit (3).
Figure 12:
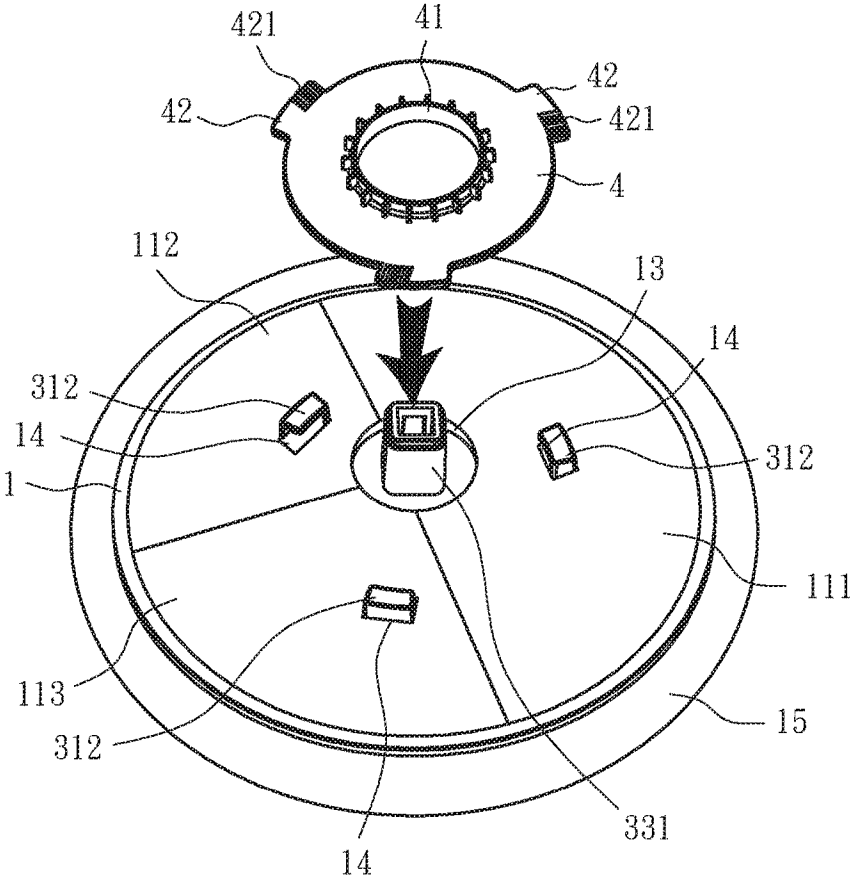
FIG. 12 is a first perspective view illustrating how the fixing unit is installed.
Figure 13:
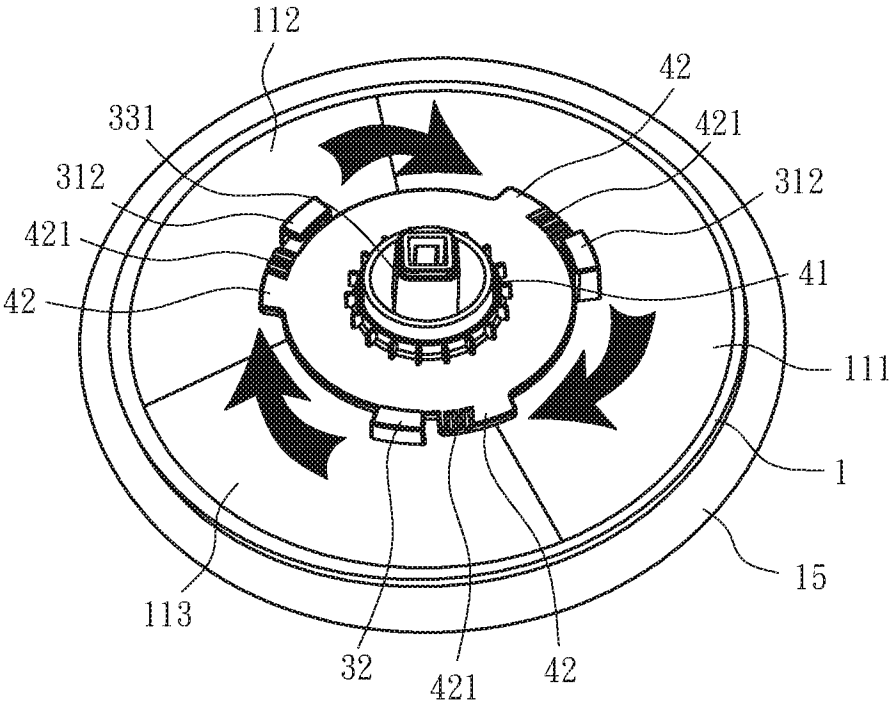
FIG. 13 is a second perspective view illustrating how the fixing unit is installed.
Figure 14:
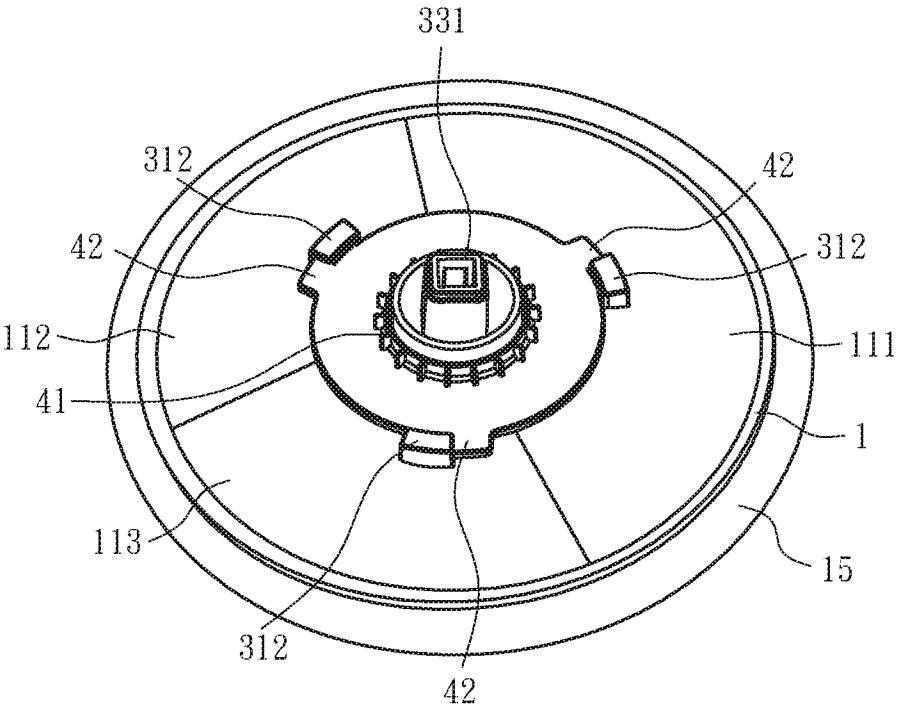
FIG. 14 is a third perspective view illustrating how the fixing unit is installed.
Figure 15:
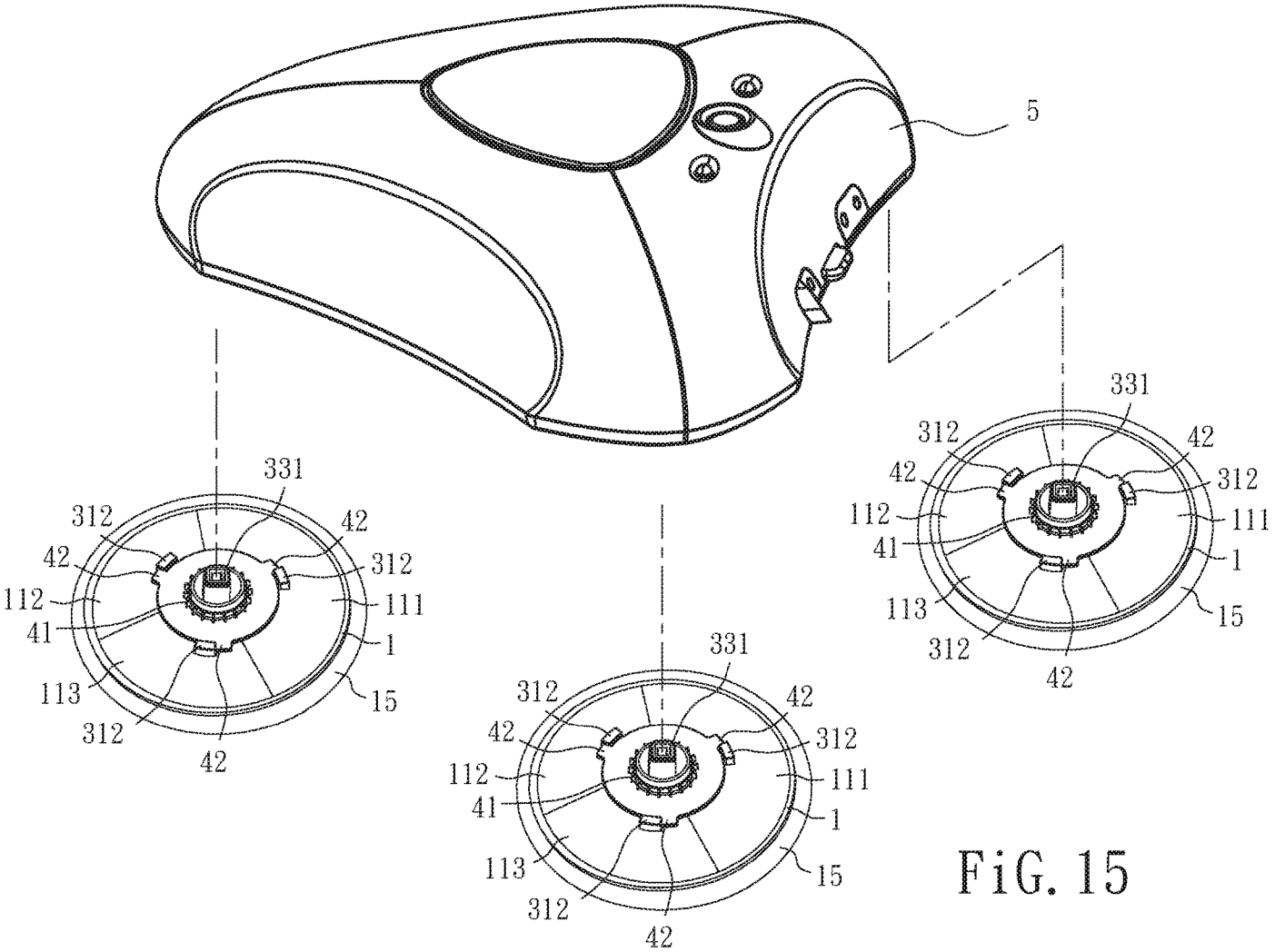
FIG. 15 is a perspective view illustrating how three assemblies of the present invention are installed on an automatic cleaning machine.

Please refer to FIGS. 9 to 11 to see how the assembly unit 3 is placed or inserted into the outer unit 1. First, use our thumb to partially open the first openable portion 111 and insert a part of the assembly unit 3 into the space 12. Now, allow one of the three engagement portions 312 to upwardly engage with the corresponding opening 14 of the first openable portion 111. Then, partially open the second openable portion 112 and third openable portion 113 and insert the other half of the assembly unit 3 into the space formed by and between the second and third openable portions 112 and 113 and the outer unit 1. Now, allow the positioning piece 331 to pass through the aperture 331 and allow the other two of the three engagement portions 312 to upwardly engage with the other two of the three openings 14, which are provided on the second openable portion 112 and third openable portion 113.

Please refer to FIGS. 12 to 15 to see how the fixing unit 4 is installed. First, move the fixing unit 4 downwardly so that the positioning opening 41 is fitted to the aperture 331 and the bottom of the fixing unit 4 rests on top of the outer unit 1. Next, rotate the fixing unit 4 in the clockwise direction so that the three male engagement pieces engage with the three engagement portions 312. Last, connect the connective piece 333 to the underside of an automatic cleaning machine through the attachment of the positioning design 3331 to the automatic cleaning machine 5. Now, the cleaning fabric assembly is installed.

The engagement between the anti-slipping portions and the engagement portions secures the connection between them and prevents accidental disconnection between them. In addition, the direction of such engagement may be designed as counter to the rotational direction of the automatic cleaning machine to prevent accidental disconnection between the assembly unit and fixing unit due to the rotation of the automatic cleaning machine.

The connective piece 333 is connected to the underside of an automatic cleaning machine 5 through the attachment of the positioning design 3331 to the automatic cleaning machine 5 or through other methods, such as engagement or fastening. In use, after the automatic cleaning machine 5 is turned on, the cleaning fabric assemblies of the present invention start to spin. Through the donut-shaped cleaning portions, such spin may gather dust and debris, which may be transferred to a dust container provided in the automatic cleaning machine. In such manner, sweeping and vacuuming may be achieved. Moreover, water stains on the floor may be absorbed and removed by the water absorbent units 2.

In addition, mopping may be achieved with the assembly too. After the water absorbent units 2 soak in water, we may use them to mop the floor. Furthermore, the automatic cleaning machine may be set so that the water absorbent units 2 may be automatically replenished with water after a period of time by going to a designated location. Therefore, the cleaning fabric assemblies of the present invention enable a single automatic cleaning machine to have dual function: sweeping and mopping.

Now, please refer to FIGS. 2, 3, 4, 5 and 15. After the assembly of the present invention is installed, the supportive portion 35, positioning portion 32 and connective portion 33 are lifted upwardly by the supportive spring 37 and positioning spring 36. Therefore, as the automatic cleaning machine moves, less friction is generated between the outer unit and the floor and thus less energy is needed by the automatic cleaning machine. If the outer unit is stuck during use, rotational power generated by the machine will not dame any part of the assembly because the engagement surfaces of either the engagement slots 3115 or the positioning design 3331 have a tilted design and thus in such case, rotational power will be passed onto the connective portion 33 and positioning portion 32.

As the machine moves over an uneven floor, the positioning spring 36 will be compressed so that an angle will be formed between the positioning portion 32 and the positioning seat 31, allowing the machine to go through the floor without overturn or being stuck.

In contrast to the cleaning fabric or brush used by the prior art sweeping robot or mopping robot, the cleaning fabric assembly of the present invention has the following advantages:

1. An automatic cleaning machine may be set so that the water absorbent units may be automatically replenished with water after a period of time by going to a designated location. Therefore, this may effectively solve the problem of the prior art mopping robot.
2. The cleaning fabric assembly will absorb water stains on the floor, thus solving a problem in the prior art.
3. To uninstall the outer unit or the water absorbent unit for replacement or cleaning, a user simply has to rotate the fixing unit to disengage the male engagement pieces from the engagement portions.
4. The cleaning fabric assembly of the present invention may impart a sweeping machine with the function of mopping.

Although a preferred embodiment of the present invention has been described in detail hereinabove, it should be understood that the preferred embodiment is to be regarded in an illustrative manner rather than a restrictive manner, and all variations and modifications of the basic inventive concepts herein taught still fall within the scope of the present invention.

From the above, we can see that the cleaning fabric assembly of the present invention meets the relevant patent requirements. It is hoped that the patent application will be approved.

What is claimed is:

1. A cleaning fabric assembly used for an automatic cleaning machine, comprising:

an outer unit, wherein a plurality of openable portions, which extend from the peripheral portion of the outer unit to the center of the outer unit, are provided on top of the outer unit, and wherein a space is formed between the openable portions and the outer unit;

an assembly unit and a fixing unit, wherein the assembly unit is disposed between the water absorbent unit and the openable portions, characterized in that a positioning opening is centrally provided in the fixing unit and that at least a male engagement piece is provided on the fixing unit, characterized in that at least an opening is provided in each of the openable portions; and a water absorbent unit, disposed inside the space.

wherein the assembly unit comprises:

a positioning seat, wherein a connective portion is centrally provided on the positioning seat and an engagement portion, which spatially corresponds to each of the openings, is circumferentially provided on the positioning seat, wherein the connective portion comprises an inner space, a plurality of connective slots, an opening, an installation opening and a plurality of engagement slots, characterized in that each of connective slots is a through slot, characterized in that each of the connective slots passes through the side wall of the connective portion and the opening is a through opening on top of the connective portion, and characterized in that the engagement slots are circumferentially disposed in the inner space near the opening;

a positioning portion, fitted inside the inner space of the connective portion, wherein the positioning portion comprises an outer ring and an engagement opening piece, characterized in that the outer ring is circumferentially provided around the positioning portion and has a plurality of engagement protrusions, which engages with the engagement slots, and characterized in that the engagement opening piece passes through the top and bottom of the positioning portion;

a connective portion, wherein the connective portion comprises a positioning piece and a retaining piece, characterized in that the positioning piece is fitted through the engagement opening piece and that the retaining piece presses against the underside of the engagement opening piece;

a bottom portion, wherein the bottom portion comprises a positioning ring piece and a plurality of engagement pieces, characterized in that the positioning ring piece is centrally provided inside the bottom portion and the engagement pieces are circumferentially provided around the bottom portion, characterized in that through the engagement pieces and connective slots, the positioning portion and connective portion are properly secured inside the inner space of the connective portion;

a supportive portion, fitted in between the connective portion and the bottom portion, characterized in that a positioning protrusion is provided on the bottom of the supportive portion;

a supportive spring, fitted in between the supportive portion and the bottom portion, characterized in that the lower end of the supportive spring is fitted to the positioning ring piece and the upper end of the supportive spring is fitted to a peripheral portion of the positioning protrusion; and a positioning spring, characterized in that the lower end of the positioning spring is fitted to the positioning ring piece and its upper end presses against the lower side of the outer ring.

2. The cleaning fabric assembly as in claim 1, wherein the positioning piece has a connective piece, which is located on the top of the positioning piece, characterized in that a positioning design is provided on the wall of the connective piece.

3. The cleaning fabric assembly as in claim 1, characterized in that the engagement surfaces of both the engagement slots and the engagement protrusions have a tilted design.

4. The cleaning fabric assembly as in claim 1, wherein an anti-slipping portion is provided on the upper surface of each male engagement piece.

5. The cleaning fabric assembly as in claim 1, characterized in that the positioning piece and engagement opening piece have the same rectangular shape.

6. The cleaning fabric assembly as in claim 1, wherein an aperture is centrally formed on the outer unit by the openable portions.

7. The cleaning fabric assembly as in claim 1, wherein a donut-shaped cleaning portion is circumferentially disposed around the outer unit.

8. The cleaning fabric assembly as in claim 1, characterized in that the water absorbent unit is made of water absorbing material and are replaceable or washable.

9. A cleaning fabric assembly, comprising:

an assembly unit, wherein a connective portion is centrally provided on the assembly unit and a plurality of engagement portions, which spatially correspond to openings, are circumferentially provided on the connective portion; and a fixing unit, wherein a positioning opening is centrally provided in the fixing unit and connects with the connective portion, characterized in that a plurality of male engagement pieces are circumferentially provided around the fixing unit, wherein the assembly unit comprises:

a positioning seat, wherein a connective portion is centrally provided on the positioning seat and an engagement portion, which spatially corresponds to each of the openings, is circumferentially provided on the positioning seat, wherein the connective portion comprises an inner space, a plurality of connective slots, an opening, an installation opening and a plurality of engagement slots, characterized in that each of connective slots is a through slot, characterized in that each of the connective slots passes through the side wall of the connective portion and the opening is a through opening on top of the connective portion, and characterized in that the engagement slots are circumferentially disposed in the inner space near the opening;

a positioning portion, fitted in the inner space of the connective portion through the installation opening, wherein the positioning portion comprises an outer ring and an engagement opening piece, characterized in that the outer ring is circumferentially provided around the positioning portion and has a plurality of engagement protrusions, which engages with the engagement slots, and characterized in that the engagement opening piece passes through the top and bottom of the positioning portion;

a connective portion, wherein the connective portion comprises a positioning piece and a retaining piece, characterized in that the positioning piece is fitted through the engagement opening piece and that the retaining piece presses against the underside of the engagement opening piece;

a bottom portion, wherein the bottom portion comprises a positioning ring piece and a plurality of engagement pieces, and wherein the positioning ring piece is centrally provided inside the bottom portion and the engagement pieces are circumferentially provided around the bottom portion, characterized in that through the engagement pieces and connective slots, the positioning portion and connective portion are properly secured inside the inner space of the connective portion;

a supportive portion, fitted in between the connective portion and the bottom portion, characterized in that a positioning protrusion is provided on the bottom of the supportive portion;

a supportive spring, fitted in between the supportive portion and the bottom portion, characterized in that the lower end of the supportive spring is fitted to the positioning ring piece and the upper end of the supportive spring is fitted to a peripheral portion of the positioning protrusion; and a positioning spring, characterized in that the lower end of the positioning spring is fitted to the positioning ring piece and its upper end presses against the lower side of the outer ring.

10. A cleaning fabric assembly as in claim 9, characterized in that an anti-slipping portion is provided on the upper surface of each male engagement piece.

11. A cleaning fabric assembly as in claim 9, wherein the positioning piece has a connective piece, which is located on the top of the positioning piece, characterized in that a positioning design is provided on the wall of the connective piece.

12. A cleaning fabric assembly as in claim 9, characterized in that the engagement surfaces of both the engagement slots and the engagement protrusions have a tilted design.

13. A cleaning fabric assembly as in claim 9, characterized in that the positioning piece and engagement opening piece has the same rectangular shape.

14. A cleaning fabric assembly as in claim 9, further comprising:

an outer unit, wherein a plurality of openable portions, which extend from the peripheral portion of the outer unit to the center of the outer unit, are provided on top of the outer unit, and wherein a space is formed between the openable portions and the outer unit, characterized in that at least an opening is provided in each of the openable portions and that the assembly unit is placed inside the space through cracks between the openable portions, and characterized in that each of the engagement portions is fitted through the corresponding opening; and a water absorbent unit, which is placed inside the space through the cracks between the openable portions and are placed between the assembly unit and the outer unit.

15. A cleaning fabric assembly as in claim 14, characterized in that the water absorbent unit is made of water absorbing material and may be replaced are replaceable or washable.

16. A cleaning fabric assembly as in claim 14, characterized in that a donut-shaped cleaning portion is circumferentially disposed around the outer unit.

17. A cleaning fabric assembly as in claim 14, characterized in that an aperture is centrally formed by the openable portions.

* * * * *